United States Patent [19]

Nozawa et al.

[11] Patent Number: 4,663,271

[45] Date of Patent: May 5, 1987

[54] COLOR PHOTOGRAPHIC LIGHT-SENSITIVE MATERIALS

[75] Inventors: Yasushi Nozawa; Noboru Sasaki, both of Kanagawa, Japan

[73] Assignee: Fuji Photo Film Co., Ltd., Kanagawa, Japan

[21] Appl. No.: 836,267

[22] Filed: Mar. 4, 1986

[30] Foreign Application Priority Data

Mar. 4, 1985 [JP] Japan ..... 60-42155

[51] Int. Cl.[4] ..... G03C 1/46; G03C 5/00

[52] U.S. Cl. ..... 430/503; 430/504; 430/506

[58] Field of Search ..... 430/503, 504, 506

[56] References Cited

U.S. PATENT DOCUMENTS 3,811,890 3/1974 Ohta et al. ..... 430/504 X
4,118,228 10/1978 Corluy et al. ..... 430/503 X
4,409,321 10/1983 Onodera et al. ..... 430/503 X
4,599,301 7/1986 Ohashi et al. ..... 430/503 X

FOREIGN PATENT DOCUMENTS 0167173 1/1986 European Pat. Off. ..... 430/503

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A color photographic light-sensitive material comprising a support having provided thereon at least one red-sensitive silver halide emulsion layer, at least one green-sensitive silver halide emulsion layer and at least one blue-sensitive silver halide emulsion layer is disclosed. The green-sensitive silver halide emulsion layer has a spectral sensitivity distribution whose wave-averaged wavelength of sensitivity ranges from 520 nm to 580 nm and the material further contains at least one silver halide emulsion layer which is light-responsive opposite to other layers and forms an image having substantially the same hue as that of the red-sensitive silver halide emulsion layer and whose spectral sensitivity distribution has a wave-averaged wavelength of sensitivity ranging from 500 nm to 560 nm. The material is excellent in both saturation of red and distinction of green colors.

9 Claims, 5 Drawing Figures

COLOR PHOTOGRAPHIC LIGHT-SENSITIVE MATERIALS

FIELD OF THE INVENTION

This invention relates to a color photographic light-sensitive material having excellent color reproducibility.

BACKGROUND OF THE INVENTION

In color photographic light-sensitive materials, it has hitherto been known to utilize an interlayer effect as a means for improving color reproducibility. Taking color negative light-sensitive materials for instance, a development inhibitory effect is produced from a green-sensitive layer towards a red-sensitive layer to thereby retard color formation of the red-sensitive layer under white light exposure as compored with color formation under exposure to red light. Since a color negative paper system has a balanced gradation so that an area exposed to white light may be reproduced in gray on a color print, the aforesaid interlayer effect provides a higher cyan density on the negative when exposed to red light than in the case of exposure to gray light. As a result, it is possible to reproduce a red color of higher saturation on the print with cyan development being inhibited. Likewise, the development inhibitory effect from a red-sensitive layer towards a green-sensitive layer results in reproduction of a green color having high saturation.

In order to enhance the interlayer effect, it is known to use an iodine ion which is released from a silver halide emulsion upon development. This technique is to increase a silver iodide content in a layer which produces an interlayer effect and to decrease a silver iodide content in a layer which accepts the interlayer effect. Another process for ensuring the interlayer effect, as disclosed in Japanese Patent Application (OPI) No. 2537/1975, comprises adding a coupler capable of releasing a development inhibitor upon reacting with an oxidation product of a developing agent in a p-phenylenediamine type color developer to a layer that produces an interlayer effect. A still another process for increasing the interlayer effect is called automatic masking, in which a colored coupler is added to cancel unnecessary absorption of a dye image obtaned from colorless couplers. According to this process using colored couplers, an increased amount of the colored coupler can not only mask unnecessary absorption of a colorless coupler but also produce an effect similar to an interlayer effect.

In an attempt to increase saturation of red and to increase image sharpness of a green-sensitive layer to which human eyes are highly sensitive and which is, therefore, visually the most important, the present inventors have found that addition of a DIR compound capable of releasing a highly diffusible development inhibitor to a green-sensitive layer can accomplish the above-described purposes but gives rise to a problem on reproducibility of green. In other words, various green colors that are perceivable by eyes, such as yellowish green, orange-tinged green, cyan-tinged green, brownish green, etc., become indistinguishable. The inventors have conducted extensive studies on this problem and reached the following conclusion.

That is, when an interlayer effect from a green-sensitive layer increases, spectral sensitivity of a blue-sensitive layer in a longer wavelength side and spectral sensitivity of a red-sensitive layer in a shorter wavelength side are reduced due to the interlayer effect so that the sensitivities of the blue-sensitive layer and red-sensitive layer in the spectral region of the green-sensitive layer substantially disappear, and only the green-sensitive layer develops a color to all wavelengths within green light. Development should normally take place in both the green-sensitive layer and other layers, i.e., a red-sensitive layer. However, too great an interlayer effect from the green-sensitive layer inhibits development of the red-sensitive layer, thus resulting in color development in only the green-sensitive layer. As a result, green colors being different in hue tend to be developed in the same color tone making distinction among them difficult.

SUMMARY OF THE INVENTION

An object of this invention is to provide a color light-sensitive material excellent in both saturation of red and distinction of various green colors.

Another object of this invention is to provide a color light-sensitive material which is free from the disadvantage generated by providing an emulsion layer having a great interlayer effect.

According to the present invention there is to provide a color photographic light-sensitive material comprising a support having provided thereon at least one red-sensitive silver halide emulsion layer, at least one green-sensitive silver halide emulsion layer and at least one blue-sensitive silver halide emulsion layer, wherein the green-sensitive layer has a spectral sensitivity distribution whose weight-averaged wavelength of sensitivity ($\overline{\lambda}_G$) ranges from 520 nm to 580 nm and the material further contains at least one silver halide emulsion layer which is light-responsive opposite to the above-described emulsion layers and forms an image of substantially the same hue as that of an image formed by the red-sensitive silver halide emulsion layer and whose spectral sensitivity distribution has a weight-averaged wavelength of sensitivity ($\overline{\lambda}_{-R}$) ranging from 500 nm to 560 nm.

DETAILED DESCRIPTION OF THE INVENTION

Figure 1:
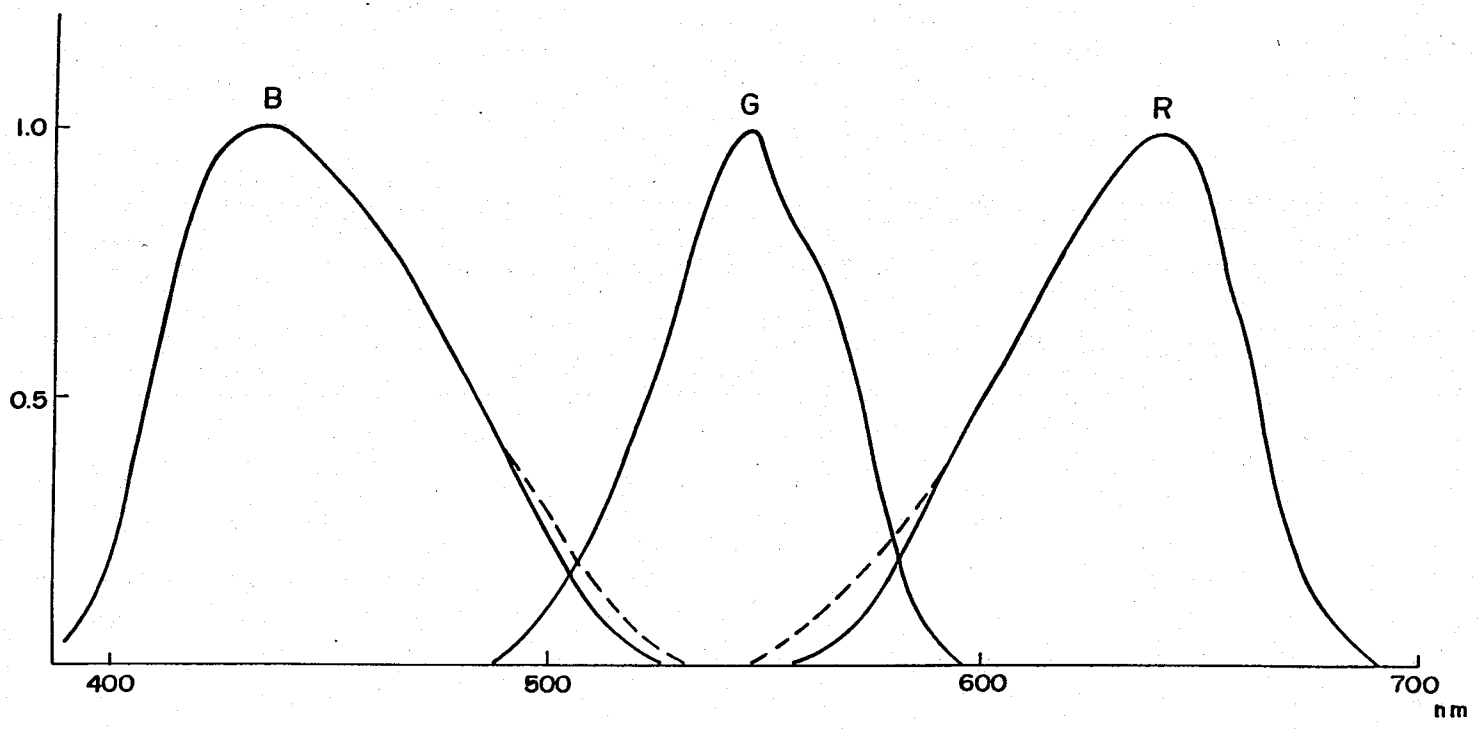
FIG. 1 shows a spectral sensitivity distribution curve of a general photographic light-sensitive material, in which the dotted lines indicate spectral sensitivity distribution curves of a red-sensitive layer and a blue-sensitive layer when an interlayer effect from a green-sensitive layer toward each of these layers is small, and the solid lines indicate those when said interlayer effect is great. Curves B, G and R are of a blue-sensitive layer, a green-sensitive layer and a red-sensitive layer, respectively.
Figure 2A:
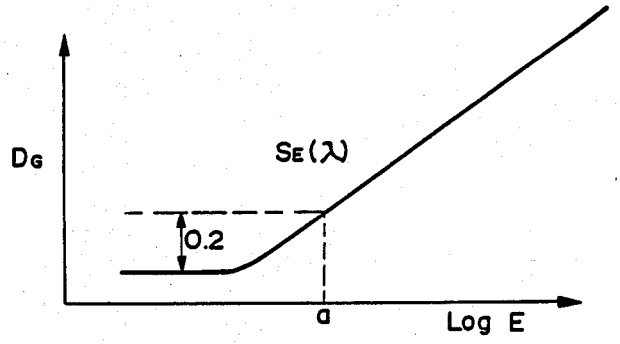
FIG. 2A shows a characteristic curve of a green-sensitive layer at a specific wavelength ($\lambda$).

"Weight-averaged wavelength of sensitivity $\bar{\lambda}_G$" as herein referred to is obtained by the formula:

$$\bar{\lambda}_G = \frac{\int_{400}^{700} \lambda \cdot S_G(\lambda) d\lambda}{\int_{400}^{700} S_G(\lambda) d\lambda}$$

wherein $S_G(\lambda)$ is a spectral sensitivity distribution curve of a green-sensitive layer, and $S_G(\lambda)$ at a specific wavelength ($\lambda$) is obtained as a relative value of a reciprocal of an exposure at the point a in FIG. 2A.

Figure 2B:
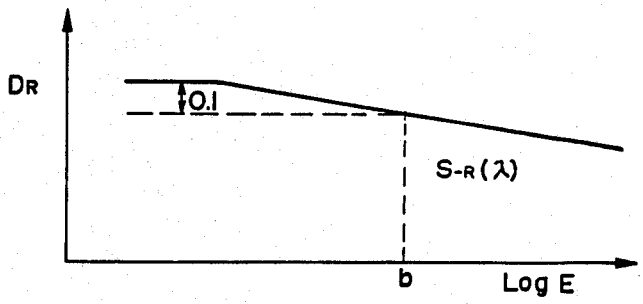
FIG. 2B shows a characteristic curve of a layer being light-responsive opposite to other layers at a specific wavelength ($\lambda$).

In the same manner, "weight-averaged wavelength of sensitivity $\bar{\lambda}_{-R}$" can be obtained from the formula:

$$\bar{\lambda}_{-R} = \frac{\int_{400}^{700} \lambda S_{-R}(\lambda) d\lambda}{\int_{400}^{700} S_{-R}(\lambda) d\lambda}$$

wherein $S_{-R}(\lambda)$ is a spectral sensitivity distribution curve of a layer which responds to light oppositely to other layers and forms an image of substantially the same hue as that of a red-sensitive silver halide emulsion layer. $S_{-R}(\lambda)$ at a specific wavelength ($\lambda$) is obtained from a relative value of a reciprocal of an exposure at the point b in FIG. 2B.

A wide variety of combinations of an emulsion and a color-forming material (color former) can be employed in carrying out the present invention. Typical examples of such combinations are as follows. Two or more of these combinations may also be used.

(1) Combinations of positively-working emulsions and cyan-forming couplers.

Positive emulsions typically include those of inner latent image type. If desired, a nucleating agent may be used in combination.

(2) Combinations of general negative emulsions and cyan-colored couplers.

The cyan-colored couplers may either be those forming colorless compounds (i.e., colorless couplers) or be those forming a magenta color.

(3) Combinations of general negative emulsions, DIR couplers or DIR compounds (e.g., DIR Hydroquinones) and previously fogged emulsions susceptible to development inhibition by development inhibitors (or precursors thereof) which are released by the DIR couplers or DIR compounds.

(4) Combinations of negative emulsions and DRR (dye releasing redox) compounds capable of releasing complete cyan dyes upon reacting with an oxidized product of a developing agent or DDR (diffusible dye releasing) couplers to form a positive image of residual color formers. These combinations may comprise positive emulsions and positive color formers.

In the present invention, it is important that an image having substantially the same hue as an image formed in a red-sensitive silver halide emulsion layer becomes a color image being light-responsive opposite to a negative image formed by a general combination of a coupler and a silver halide emulsion layer, i.e., a positive color image upon responding to light of from 500 nm to 560 nm. In other words, a positive image of a cyan color that is usually formed in a red-sensitive silver halide emulsion layer should be formed in response to the above-described short wavelength light in a green-sensitive region.

Working embodiments of the present invention will be described below in sequence.

It is advantageous to utilize a positive emulsion. This light-sensitive silver halide emulsion exhibits light-response opposite to that of light-sensitive silver halide emulsions used in other layers and is spectrally sensitized so as to have $\bar{\lambda}_{-R}$ ranging from 500 nm to 560 nm both inclusive. The objects of this invention can easily be achieved by this method. The term "opposite light-response" as herein used means positive light-response oppósite to negative light-response.

The positively responding silver halide emulsion, the so-called direct positive silver halide emulsion, which can be used in the present invention can be prepared by known processes. A typical known process comprises treating a so-called inner latent image type silver halide emulsion having a sensitivity speck inside the emulsion grains with a fogging agent or a nucleating agent. The inner latent image type silver halide emulsion is described, e.g., in U.S. Pat. Nos. 2,592,250, 3,206,313, 3,447,927, 3,761,276, 3,935,014, etc. The fogging agent or nucleating agent typically includes hydrazines as described in U.S. Pat. Nos. 2,588,982 and 2,563,785; hydrazides and hydrazones disclosed in U.S. Pat. No. 3,227,552; quaternary salt compounds disclosed in British Pat. No. 1,283,835, Japanese Patent Publication No. 38164/74, U.S. Pat. Nos. 3,734,738, 3,719,494 and 3,615,615; sensitizing dyes carrying a substituent having fogging activity in the molecule disclosed in U.S. Pat. No. 3,718,470; and acylhydrazinophenylthiourea compounds described in U.S. Pat. Nos. 4,030,925 and 4,031,127.

Another useful example of a direct positive silver halide emulsion is the one previously fogged by subjecting the surface of the silver halide grains to chemical treatment or exposure to radiation. Such an emulsion is classified into two types. One of which is such a type that silver halide has nuclei capable of trapping free electrons in the interior thereof and the surface of the silver halide is previously fogged. This type of emulsion is characterized by providing a positive image directly by itself. It is possible not only to increase sensitivity through spectral sensitization by adding a sensitizing dye but also to increase sensitivity in inherent absorption region. As free electron-trapping nuclei of this type of emulsion, salts of the group VIII metals of a Periodic Table are preferably used.

Another type of the previously fogged emulsion is such that free electron-trapping nuclei are not given to the interior of silver halides and the surface of the silver halides is chemically fogged. This type of emulsion does not per se provide a direct positive image but, instead, provides a direct positive image with an aid of an organic desensitizer.

Examples of using emulsions having electron-trapping nuclei are described in Japanese Patent Publication Nos. 4125/68 and 29405/68, U.S. Pat. Nos. 2,401,051, 2,976,149 and 3,023,102, British Pat. Nos. 707,704 and 1,097,999, French Pat. Nos. 1,520,824 and 1,520,817 and Belgian Pat. Nos. 713,272, 721,567 and 681,768.

Examples of using emulsions having no electron-trapping nuclei are described in British Pat. Nos. 1,186,717, 1,186,714 and 1,186,716 and U.S. Pat. Nos. 3,501,306, 3,501,307, 3,501,310, 3,531,288 and 1,520,817.

In the case when couplers are used as dye image-forming materials, use of colored couplers can provide a light-sensitive layer whose response to light is substantially opposite to that of other layers while the light-sensitive silver halide therein has the same light response as that of other layers. In order to meet the purpose of the present invention, for example, to form a cyan dye image in a red-sensitive silver halide emulsion layer, a cyan-colored colorless coupler or a cyan-colored magenta couplers may be employed in the emulsion layer to be made opposite in light-response. Specific examples of the colored couplers are given, e.g., in Japanese Patent Application No. 90411/83.

Further, an emulsion layer unit being oppositely responsive to light can also be obtained by a combination of a light-sensitive silver halide emulsion layer having the same light-responsiveness as other layers which has been spectrally sensitized so as to have $\overline{\lambda}_{-R}$ of from 500 nm to 560 nm both inclusive and containing a DIR compound capable of releasing a development inhibitor or a precursor thereof upon coupling with an oxidized developing agent, and an adjacent layer containing a previously fogged silver halide emulsion and a coupler capable of forming an image having substantially the same hue as that of the image of a red-sensitive silver halide emulsion layer. Methods of obtaining such an oppositely responding emulsion layer unit are described, e.g., in U.S. Pat. No. 3,227,551.

Spectral sensitization of a silver halide emulsion layer or layer unit being light-responsive opposite to other layers so as to have $\lambda_{-R}$ between 500 nm and 560 nm both inclusive can be carried out by using known methine dyes. Particularly useful dyes include cyanine dyes, merocyanine dyes and complex merocyanine dyes. Specific examples of preferred sensitizing dyes are shown below.

1

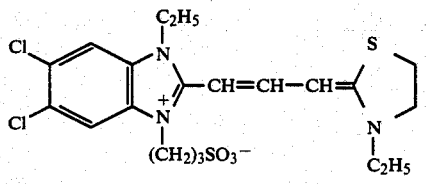

2

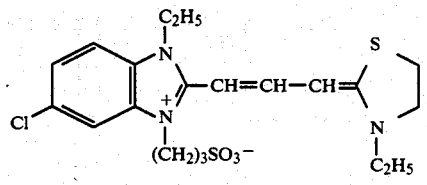

3

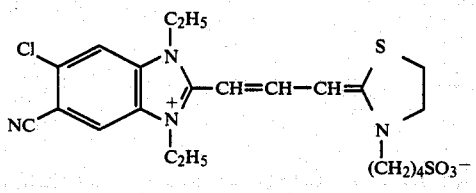

4

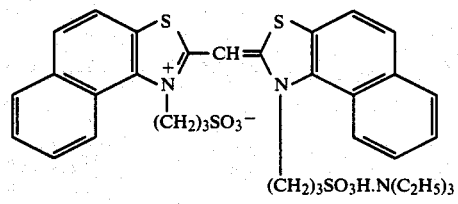

5

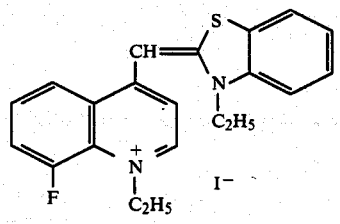

6

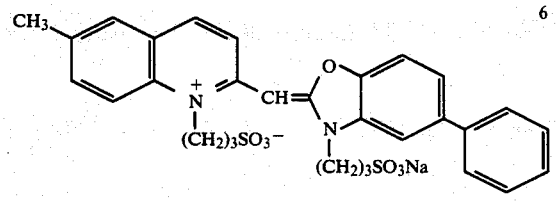

7

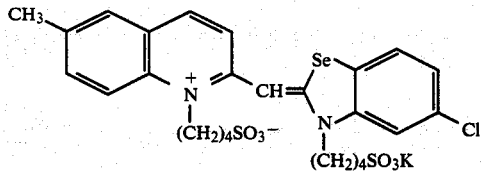

8

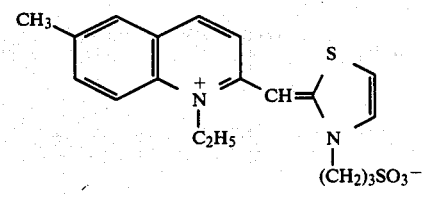

9

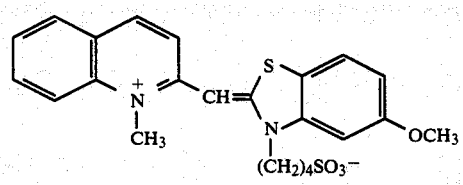

10

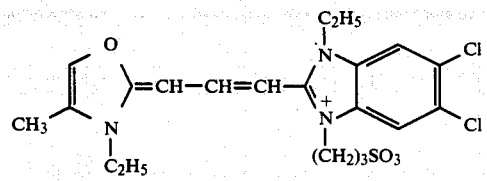

-continued
11
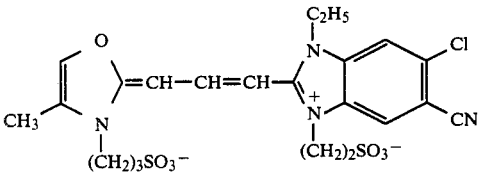
12
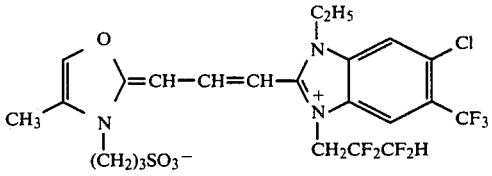
13
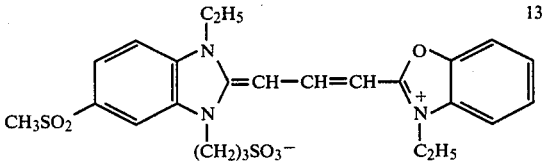
14
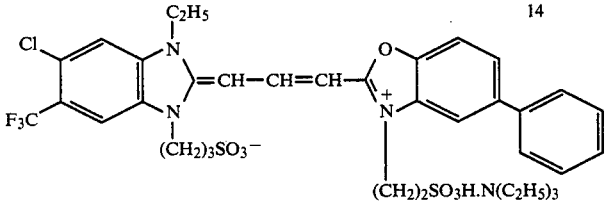
15
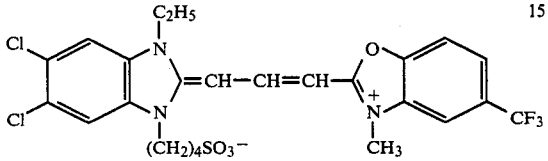
16
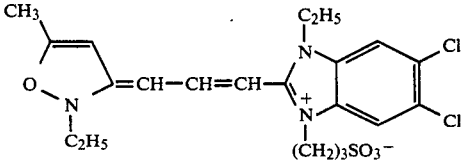
17
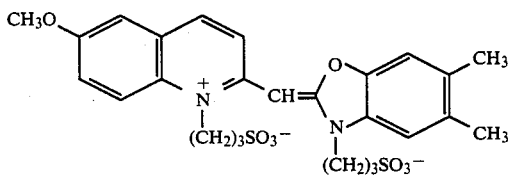
18
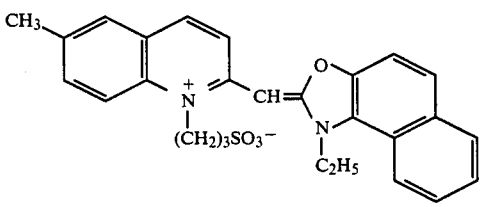
19
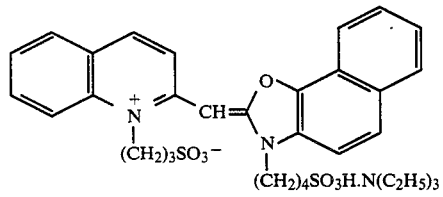
20
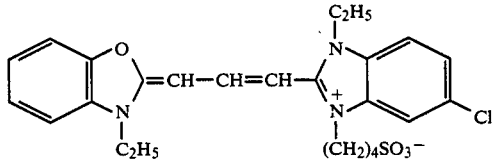
21
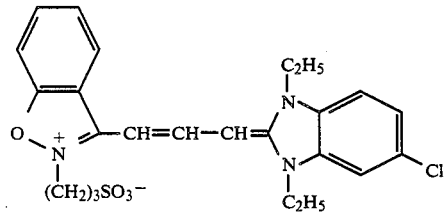
22
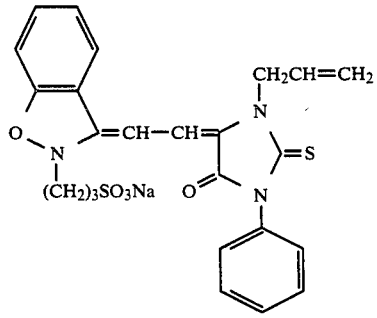

-continued

23

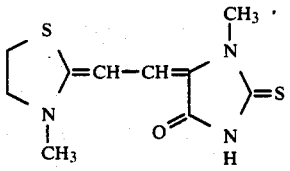

24

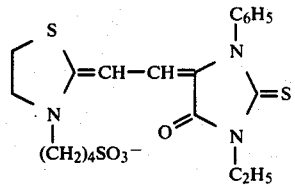

25

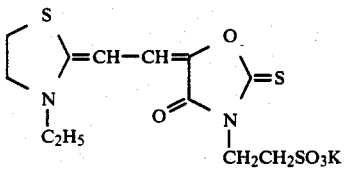

26

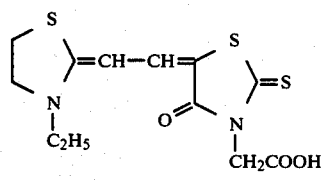

27

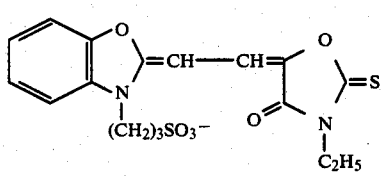

28

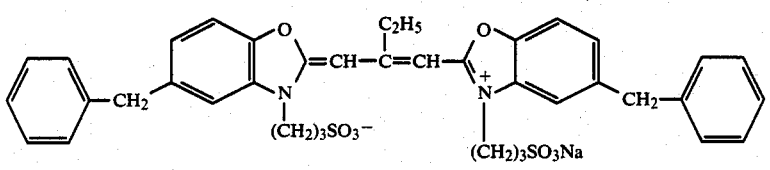

29

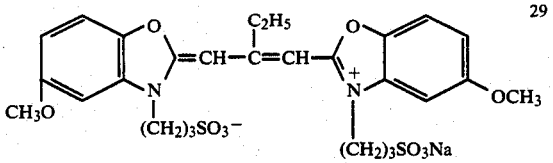

30

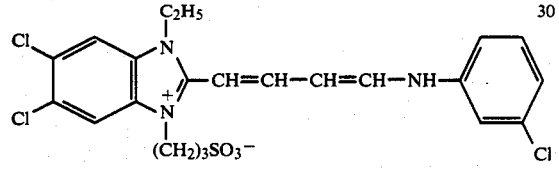

31

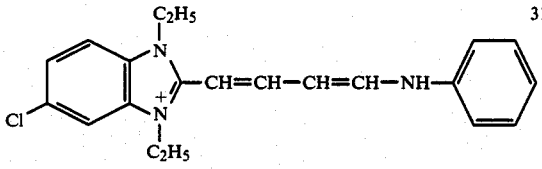

32

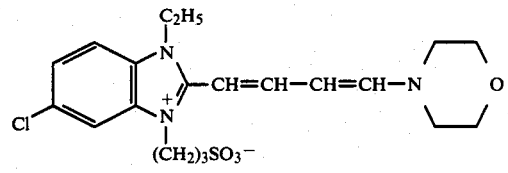

33

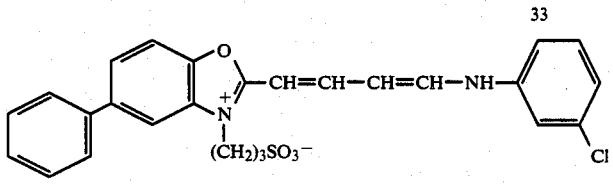

In the color photographic light-sensitive materials of the present invention, the so-called DIR couplers capable of releasing a development inhibitor with a progress of development may be utilized according to the above-recited combination (3).

The DIR couplers include, for example, those releasing heterocyclic mercapto type development inhibitors disclosed in U.S. Pat. No. 3,227,554; those releasing benzotriazole derivatives as development inhibitors disclosed in Japanese Patent Publication No. 9942/83; the so-called colorless DIR couplers disclosed in Japanese Patent Publication No. 1614/76; those causing decomposition of methylol after release to thereby release nitrogen-containing heterocyclic development inhibitors disclosed in Japanese Patent Application (OPI) No. 90932/77; those causing intramolecular nucleophilic reaction after release to thereby release development inhibitors disclosed in U.S. Pat. No. 4,248,962; those causing electron transfer via a conjugated system after release to thereby release development inhibitors as disclosed in Japanese Patent Application (OPI) Nos. 114946/81, 56837/82, 154234/82, 188035/82, 98728/83, 209736/83, 209737/83, 209738/83 and 209740/83; those releasing diffusible development inhibitors that are deactivated in a developer as disclosed in Japanese Patent Application (OPI) Nos. 151944/82 and 217932/83, etc.; those releasing reactive compounds that produce or deactivate development inhibitors upon reaction within layers at the time of development as disclosed in Japanese Patent Application Nos. 38263/74 and 39653/84, etc.; and the like. Among these DIR couplers, the preferred in the present invention are developer-deactivated DIR couplers as in Japanese Patent Application (OPI) No. 151944/82; timing type DIR couplers as in U.S. Pat. No. 4,248,962 and Japanese Patent Application (OPI) No. 154234/82; and reactive type DIR couplers as in Japanese Patent Application No. 39653/84. Of these, the particularly preferred are developer-deactivated DIR couplers described in Japanese Patent Application (OPI) Nos. 151944/82, 217932/83, 75474/84, 82214/84 and90438/84, etc.; and reactive DIR couplers described in Japanese Patent Application (OPI) No. 39653/84, etc.

Specific examples of the DIR couplers which can preferably be used in combination with the present invention are shown below.

D-1

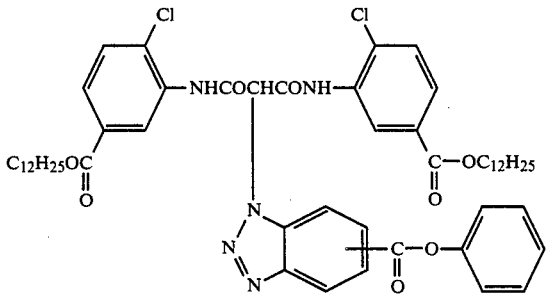

D-2

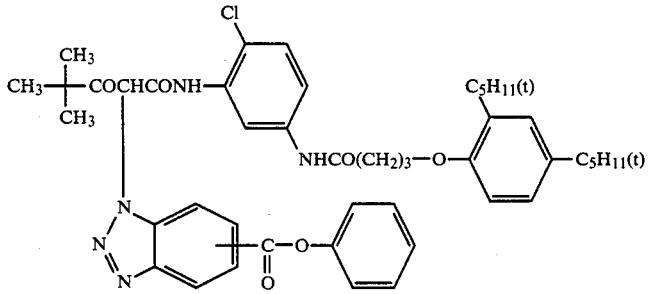

D-3

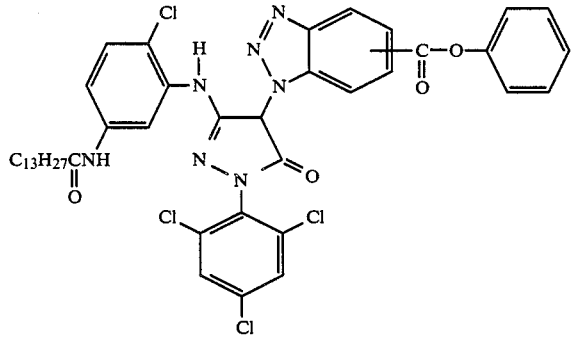

D-4

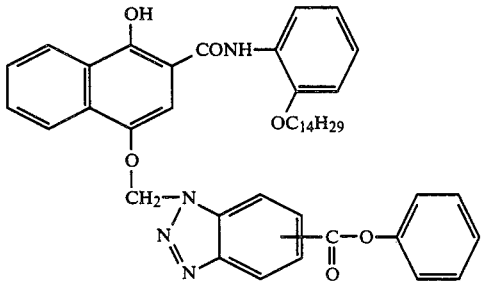

-continued
D-5
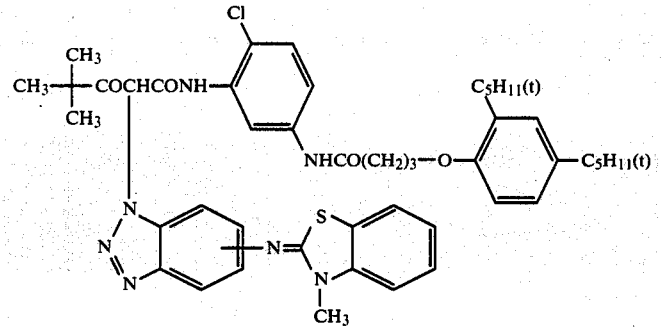
D-6
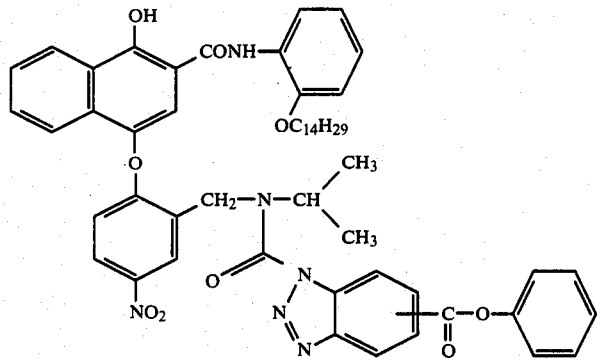
D-7
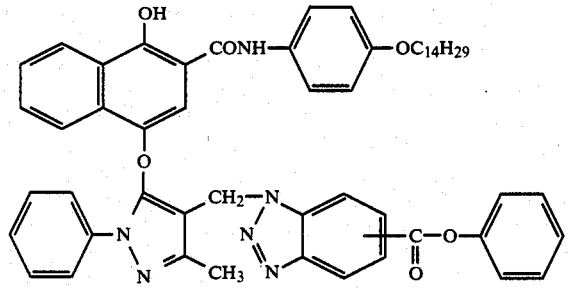
D-8
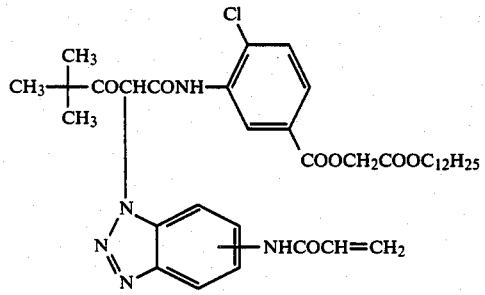
D-9
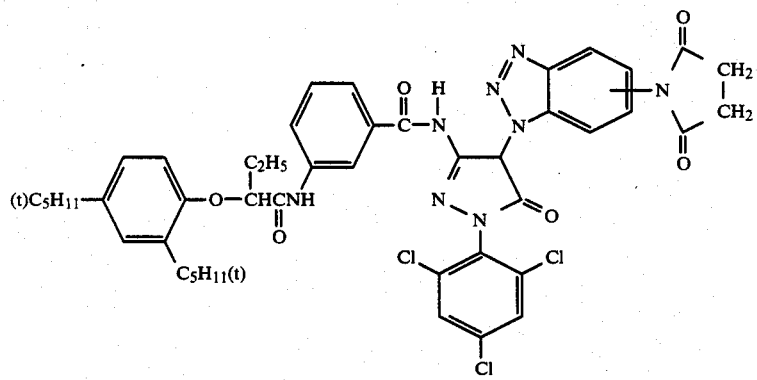

-continued
D-10
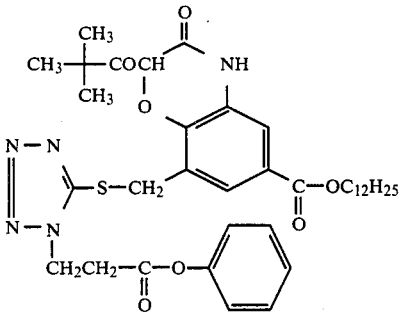
D-11
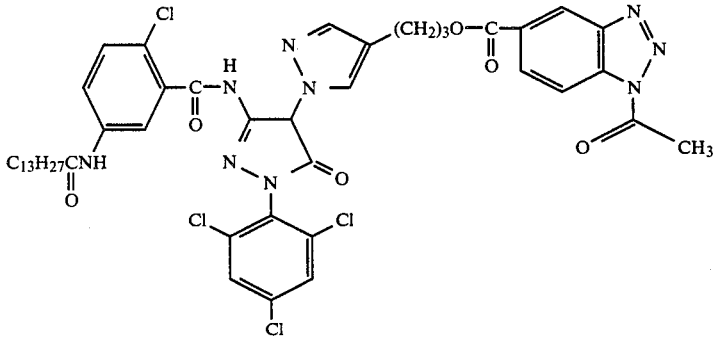
D-12
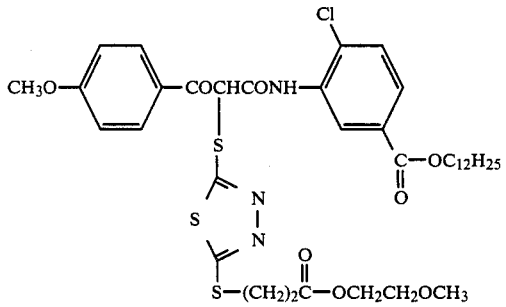
D-13
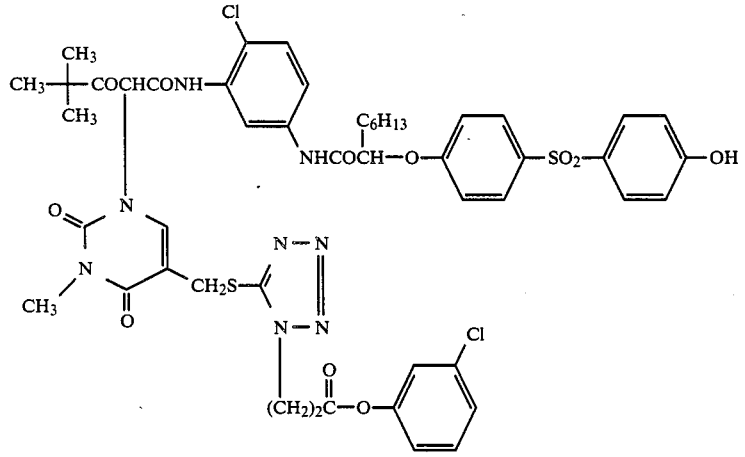

-continued
D-14
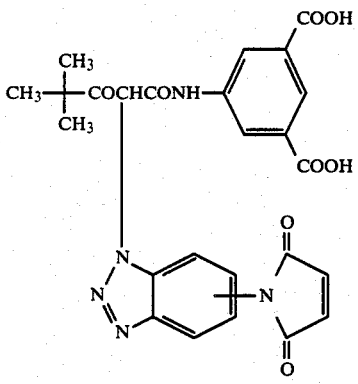
D-15
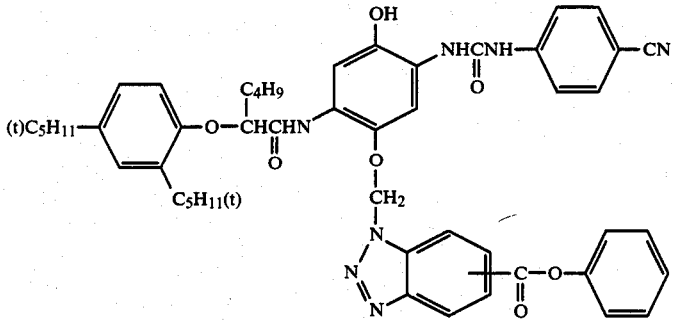
D-16
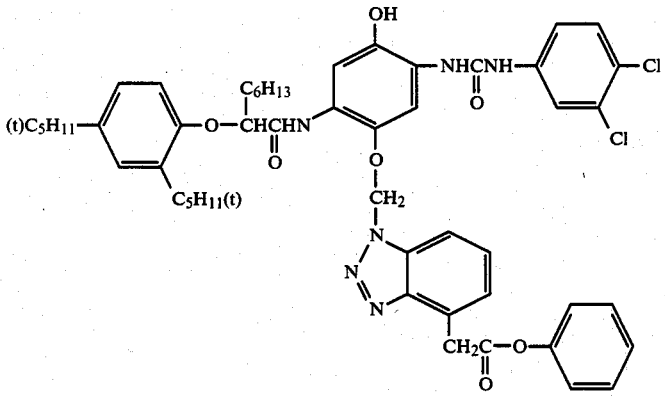
D-17
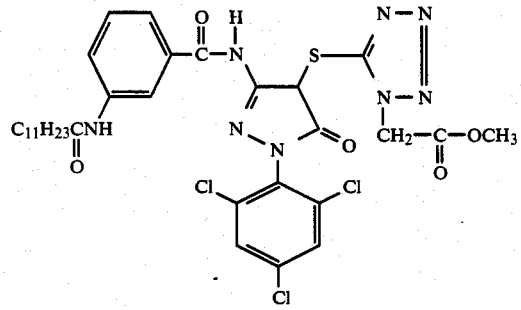

-continued
D-18
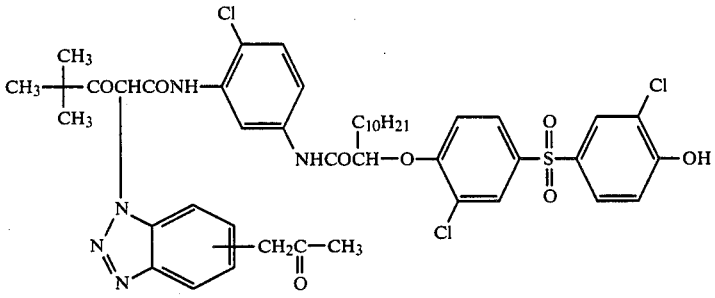
D-19
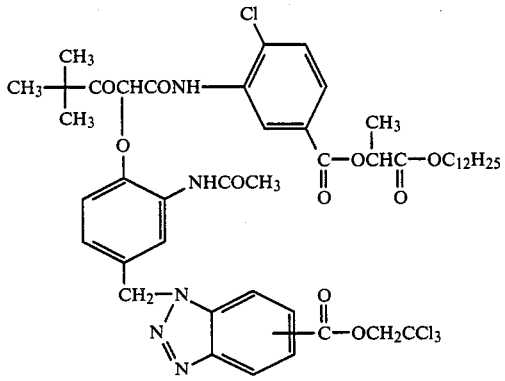
D-20
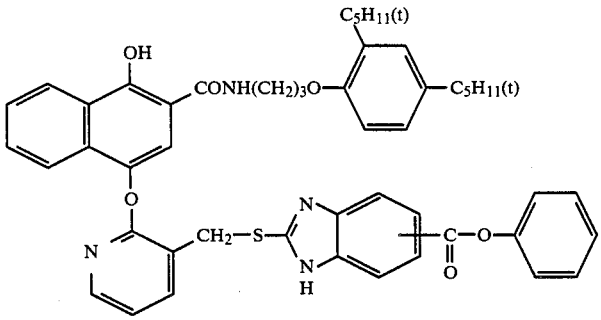
D-21
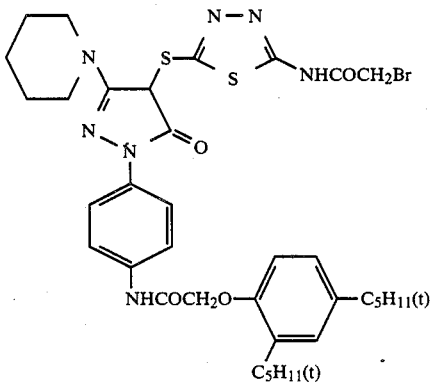

-continued
D-22
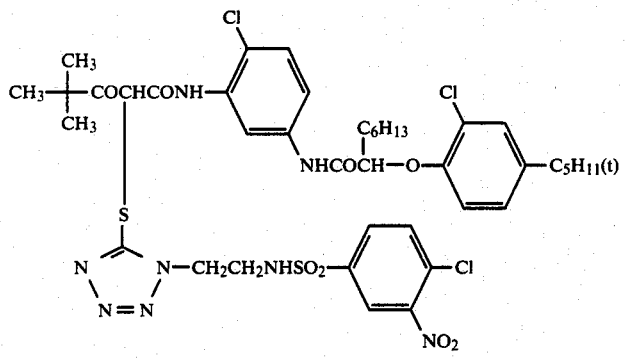
D-23
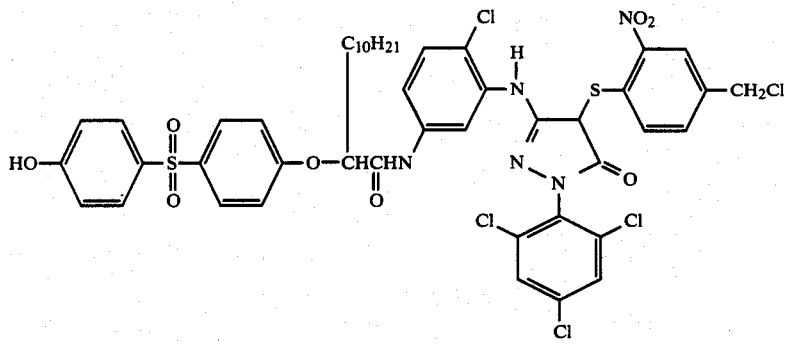
D-24
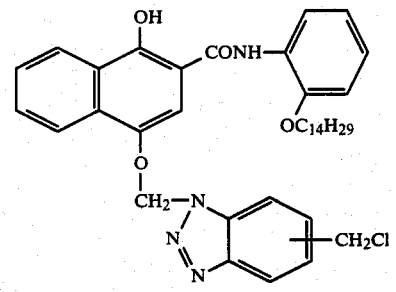
D-25
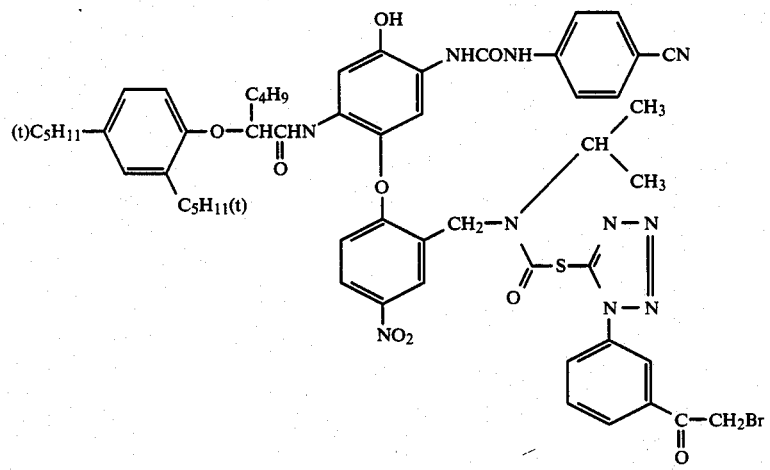

-continued
D-26
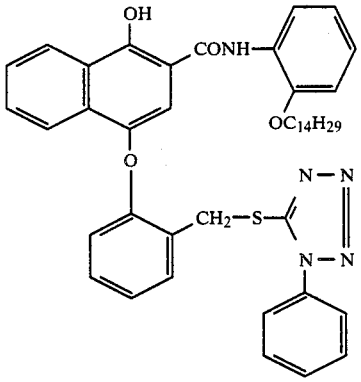
D-27
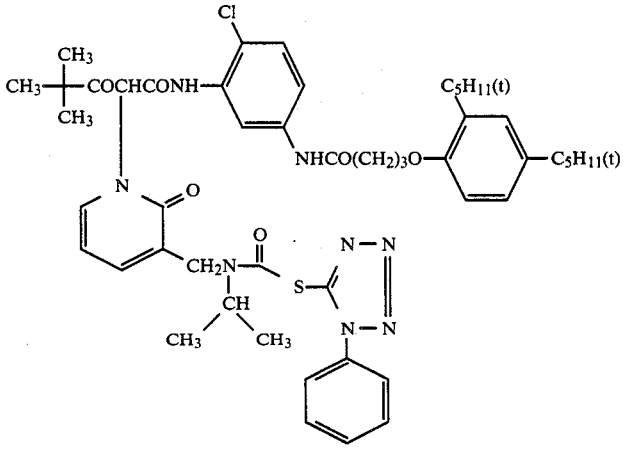
D-28
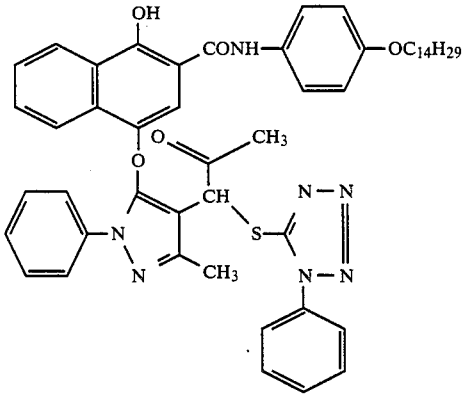
D-29
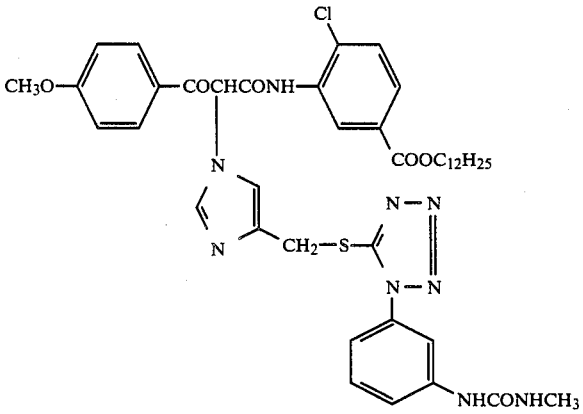

-continued
D-30
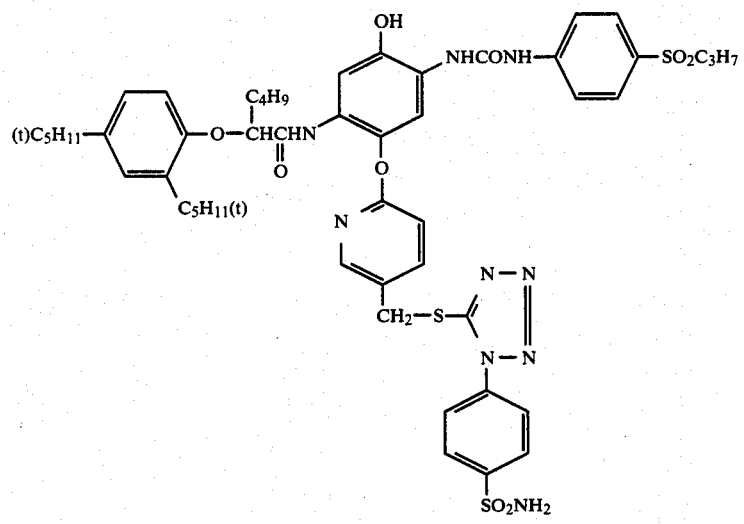
D-31
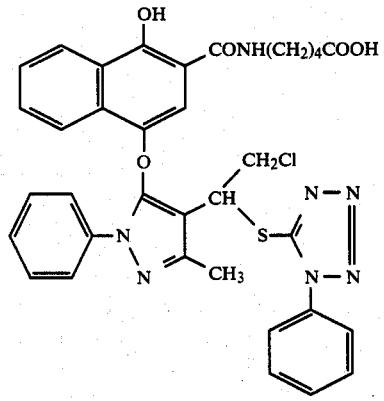
D-32
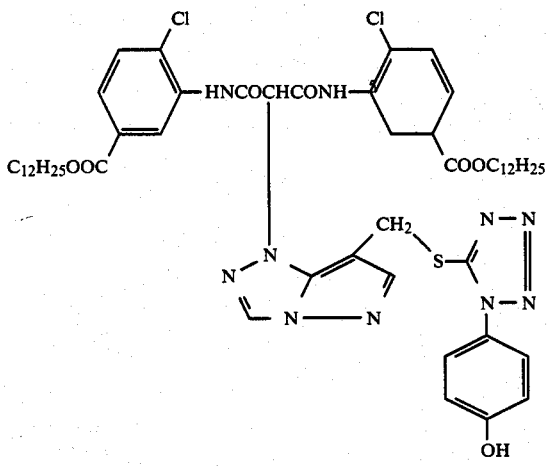

-continued
D-33
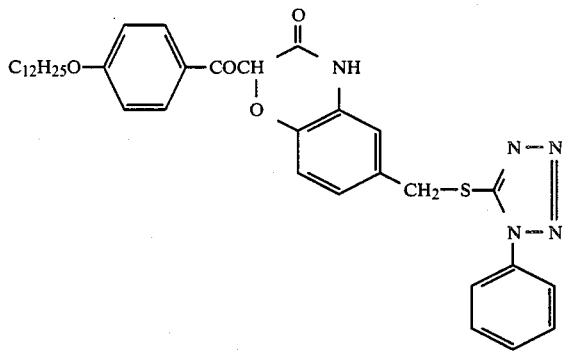
D-34
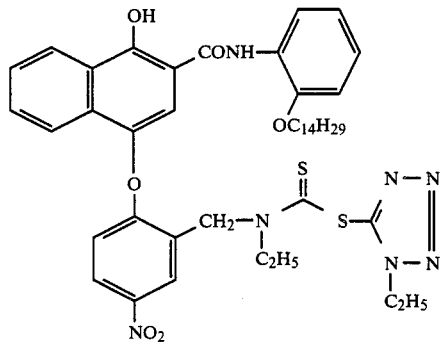
D-35
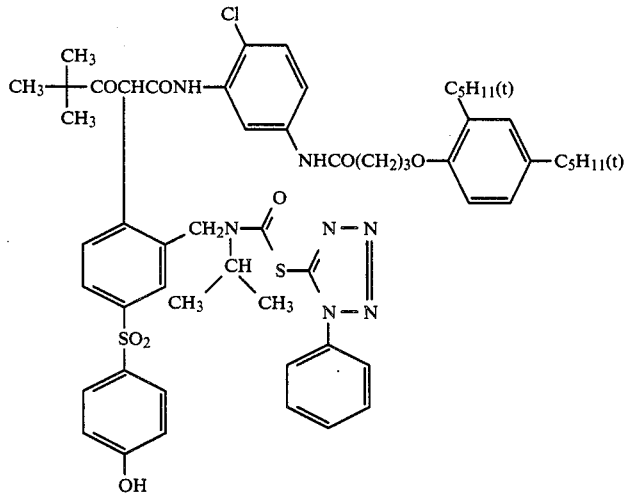
D-36
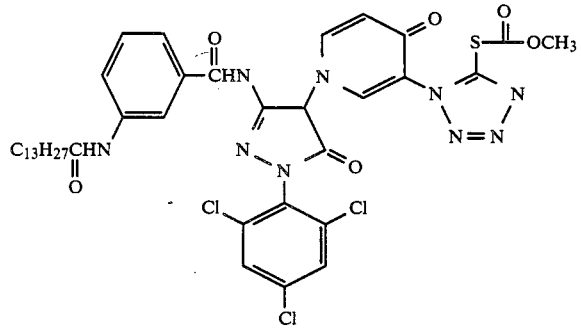

-continued
D-37
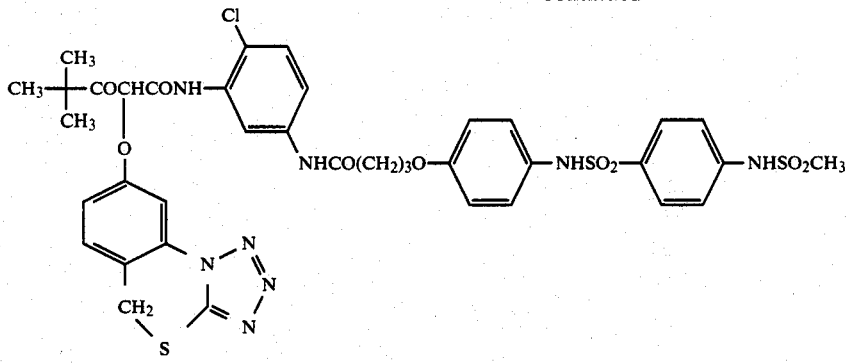
D-38
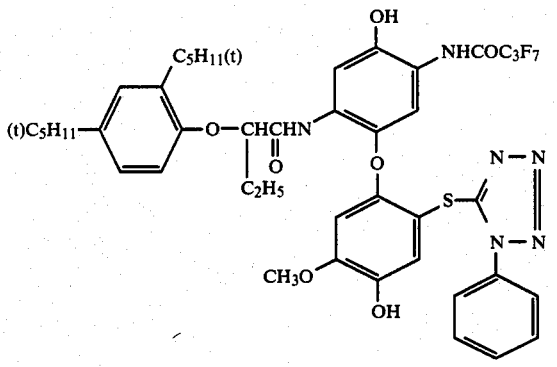
D-39
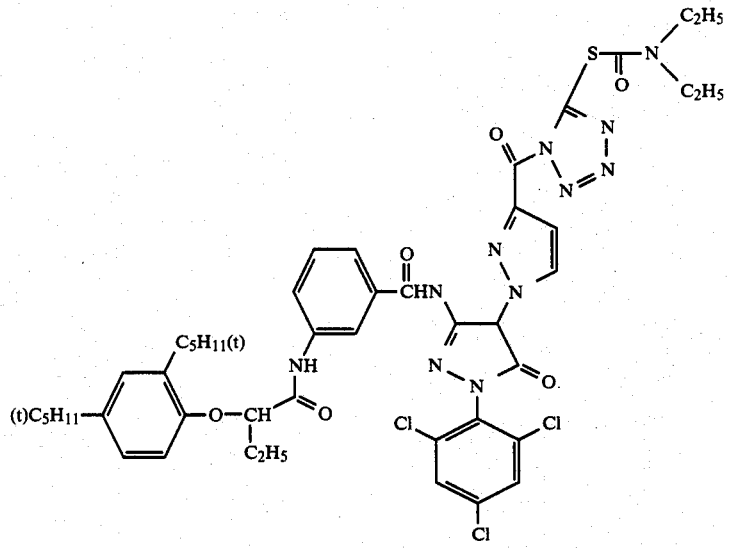
D-40
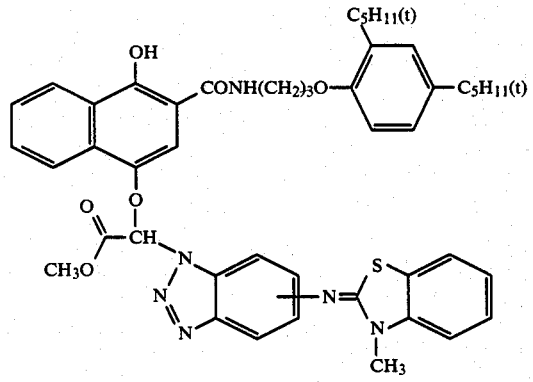
In the cases where a previously fogged silver halide emulsion layer is used in accordance with the combina- The positive dye image formed in the present invention has a lower dye density as the exposure increases. For example, the positive dye image as referred to in the present invention is formed when a dye is released from a cyan color former in the uniformly colored layer substantially in proportion to the logarithm of an exposure or when formation of a cyan dye formed from a colorless coupler, etc. is inhibited substantially in proportion to the logarithm of an exposure.

It is not clear why distinguishability of green colors can be improved by the present invention. Anyhow, according to the prior art, if an interlayer effect ocurs from a green-sensitive layer to a red-sensitive layer to improve saturation of red, color formation in the red-sensitive layer is inhibited over the whole green-sensitive region as mentioned before to the ultimate disadvantage that distinguishability of green colors becomes poor. To the contrary, the present invention makes it possible to set a spectral sensitivity distribution that gives an interlayer effect from a green-sensitive layer to a red-sensitive layer separately from that of a green-sensitive layer. Accordingly, even if an interlayer effect sufficient for increasing saturation of red is exerted, color formation in the red-sensitive layer is not so inhibited with green light having a certain $\lambda_{max}$ but is sufficiently inhibited with green light having a certain $\lambda_{max}$, whereby various green colors can be distinguished.

Not only for distinction of green colors but also for natural color reproduction, it is preferable that $\bar{\lambda}_{-R}$ be less than $\bar{\lambda}_G$. Further, for sufficiently clear distinction of green colors, $\bar{\lambda}_G$ is more preferably greater than $\bar{\lambda}_{-R}$ by at least 5 nm ($\bar{\lambda}_G-\bar{\lambda}_{-R}\geqq 5$ nm), and most preferably by at least 10 nm ($\bar{\lambda}_G-\bar{\lambda}_{-R}\geqq 10$ nm).

Specific examples of DRR compounds which can be used in the present invention are described in Japanese Patent Application (OPI) Nos. 33826/73, 54021/76 and 71071/81, typically including 4-sulfonamido-1-naphthol and 2-sulfonamidophenol derivatives. Positive dye image-donating compounds include compounds described in Japanese Patent Application (OPI) Nos. 110827/78, 110828/78 and 164342/81. It is particularly preferable to use compounds having a quinone type nucleus as described in Japanese Patent Application (OPI) No. 110827/78 in combination with precursors of electron donators. Completes dyes to be used as these compounds preferably include cyan dyes. Monoazo dyes or azo dyes having a chelating group may also be used. Typical dye moieties are described in Japanese Patent Application OPI) Nos. 126331/74, 109928/76 and 99431/79.

Silver halides which can be used in the photographic emulsion layers of the light-sensitive materials of the present invention may be any of silver bromide, silver iodobromide, silver iodochlorobromide, silver chlorobromide and silver chloride. Of these, silver iodobromide or silver iodochlorobromide containing not more than 30 mol% of silver iodide is preferred, with silver iodobromide containing from 2 to 25 mol% of silver iodide being more preferred.

Silver halide grains in the photographic emulsions may have a regular crystal form, such as a cube, an octahedron, a tetradecahedron, etc., or an irregular crystal form, such as a sphere, or a crystal form having a lattice detect, e.g., a twinning plane, or a composite form thereof.

Silve halide grains may be fine grains having a grain size of 0.1 μm or smaller or giant grains having a projected area diameter of up to 10 μm. The silver halide emulsions may be either mono-dispersed emulsions having narrow size distribution or polydispersed emulsions having broad size distribution.

The general negative photographic emulsions which can be used in the present invention can be prepared by the processes described, e.g., in P. Glafkides, *Chimie et Physique Photographique,* Paul Montel (1967), G. F. Duffin, *Photographic Emulsion Chemistry,* Focal Press (1966), V. L. Zelikman et al., *Making and Coating Photographic Emulsion,* Focal Press (1964), etc. In some detail, the emulsions can be prepared by any of the acid process, the neutral process, the ammonia process, and the like. Methods for reacting a soluble silver salt and a soluble halogen salt include a single jet method, a double jet method, a combination thereof, etc. A method is which silver halide grains are produced in the presence of excess silver ions (the so-called reverse mixing method) can be employed. In addition, the so-called controlled double jet method, in which the pAg of the liquid phase wherein silver halide grains are to be precipitated is maintained constant, may also be used. According to this method, silver halide emulsion in which grains have a regular crystal form and an almost uniform size can be obtained.

Two or more silver halide emulsions separately prepared may be employed in the form of a mixture.

The above-described silver halide emulsions comprising regular silver halide grains can be obtained by controlling the pAg and pH values during the grain formation. Details therefor are described, e.g., in *Photographic Science and Engineering,* 6, 159–165 (1962), *Journal of Photographic Science,* 12, 242–251 (1964), U.S. Pat. No. 3,655,394 and British Pat. No. 1,413,748.

The mono-dispersed emulsions are described in Japanese Patent Application (OPI) Nos. 8600/73, 39027/76, 83097/76, 137133/78, 48521/79, 99419/79, 37635/83 and 49938/83, Japanese Patent Publicatio No. 11386/72, U.S. Pat. No. 3,655,394 and British Pat. No. 1,413,748, etc.

Further, tabular grains having an aspect ratio of 5 or more may also be used in the present invention. Tabular grains can easily be prepared by the processes described in Cleve, *Photography Theory and Practice,* 131 (1930), Gutoff, *Photographic Science and Engineering,* 14, 248–257 (1970), U.S. Pat. Nos. 4,434,226, 4,414,310 and 4,433,048 and British Pat. No. 2,112,157. Use of the tabular grains brings about advantages, such as increased covering power, increased efficiency of color sensitization with sensitizing dyes, and the like, the details thereof being described in the above-cited U.S. Pat. No. 4,434,226.

The halogen composition of the individual silver halide grains may be homogeneous throughout the crystal or different between the inner portion and the outer portion. In the latter case, the halogen composition may have a layered structure. These emulsion grains are disclosed in British Pat. No. 1,027,146, U.S. Pat. Nos. 3,505,068 and 4,444,877 and Japanese Patent Application No. 248469/83. The silver halide grains may have fused thereto silver halide having a different composition or a compound other than silver halide, e.g., silver rhodanide, lead oxide, etc., through epitaxy. Such epitaxially grown grains are disclosed in U.S. Pat Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, Japanese Patent Application (OPI) No. 162540/84, etc.

Mixtures of silver halide grains having various crystal forms may also be employed.

For accelerated ripening, use of a silver halide solvent is effective. For example, it is known that ripening can be accelerated in the presence of an excessive halogen ion. Therefore, it is obvious that ripening can be accelerated simply by introducing a halide salt solution to a reaction vessel. Other ripening accelerators may also be employed. These ripening accelerators may either be incorporated all at once in a dispersing medium in the reaction vessel before addition of silver salts and halide salts or be introduced simultaneously with addition of one or more of halide salts, silver salts and peptizers. They may also be introduced to the reaction vessel independently at the stage of adding halide salts and silver salts.

Employable ripening accelerators other than halogen ions include ammonia, amine compounds, thiocyanates, e.g., alkali metal thiocyanates (particularly, sodium or potassium thiocyanate), and ammonium thiocyanate. Use of thiocyanate ripening accelerators are taught in U.S. Pat. Nos. 2,222,264, 2,448,534 and 3,320,069. Commonly employed thioethers as described in U.S. Pat. Nos. 3,271,157, 3,574,628 and 3,737,313 or thione compounds as described in Japanese Patent Application (OPI) Nos. 82408/78 and 144319/78 may also be employed as ripening accelerators.

Properties of silver halide grains can be controlled by conducting precipitation of silver halide grains in the presence of various compounds. These compounds may either be present in a reaction system from the initial stage of the reaction or be added to the reaction system simultaneously with addition of one or more of salts in a usual manner. Such compounds include compounds of copper, iridium, lead, bismuth, cadmium or zinc; chalcogen compounds of sulfur, selenium or tellurium; compounds of gold or the group VII noble metals; and the like. The silver halide emulsion may be subjected to reduction sensitization in the interior of silver halide grains during the precipitation step as described in Japanese Patent Publication No. 1410/83 and Moisar et al., *Journal of Photographic Science,* 25, 19–27 (1977).

Silver halide emulsions are usually subjected to chemical sensitization. Chemical sensitization can be carried out by using actice gelatin as described in T. H. James, *The Photographic Process,* 4th ed., 67–76, MacMilan (1977), or using sulfur, selenium, tellurium, gold, platinum, palladium, iridium or a combination thereof at a pAg value of from 5 to 10, a pH value of from 5 to 8 and a temperature of from 30° to 80° C. as described in *Research Disclosure,* Vol. 120, 12008 (April, 1974), ib., Vol. 34, 13452 (June, 1975), U.S. Pat. Nos. 2,642,361, 3,297,446, 3,772,031, 3,857,711, 3,901,714, 4,266,018 and 3,904,415 and British Pat. No. 1,315,755. The most preferred chemical sensitization is effected in the presence of a gold compound and a thiocyanate compound or in the presence of a sulfur-containing compound, e.g., those disclosed in U.S. Pat. Nos. 3,857,711, 4,266,018 and 4,054,457, Hypo, thiourea compounds, rhodanine compounds, etc. A chemical sensitization accelerator known to inhibit fog and to increase sensitivity during the chemical sensitization, such as azaindenes, azapyridazines and azapyrimidines, may be used, if desired. Examples of the chemical sensitization accelerators are described in U.S. Pat. Nos. 2,131,038, 3,411,914 and 3,554,757, Japanese Patent Application (OPI) No. 126526/83 and G. F. Duffin, *Photographic Emulsion Chemistry,* 138–143, Focal Press (1966).

In addition to or in place of the above-described chemical sensitization, the silver halide emulsions may be subjected to reduction sensitization by using, for example, hydrogen as disclosed in U.S. Pat. Nos. 3,891,446 and 3,984,249, or using reducing agents, such as stannous chloride, thiourea dioxide, polyamines, etc., as described in U.S. Pat. Nos. 2,518,698, 2,743,182 and 2,743,183; or by treating at a low pAg value, e.g., less than 5, and/or a high pH value, e.g., higher than 8. Further, color sensitivity may also be improved by the chemical sensitization method disclosed in U.S. Pat. Nos. 3,917,485 and 3,966,476.

In the present invention, various color couplers can be used. Typical color couplers to be used are cyan, magenta and yellow color-forming couplers described in patents cited in *Research Disclosure,* 17643 VII-D (December, 1979), ib., 18717 (November, 1979). These couplers are preferably made anti-diffusible by introduction of a ballast group or di- or polymerization. They may be either two-equivalent or four-equivalent.

Yellow couplers which can be used in the present invention preferably include α-pivaloyl- or α-benzoylacetanilide couplers releasable at an oxygen atom or a nitrogen atom. Particularly preferred examples of these 2-equivalent couplers include oxygen atom-releasable yellow couplers described in U.S. Pat. Nos. 3,408,194, 3,447,928, 3,933,501 and 4,022,620 and nitrogen-releasable yellow couplers described in U.S. Pat. Nos. 3,973,968 and 4,314,023, Japanese Patent Publication No. 10739/83, Japanese Patent Application (OPI) No. 132926/75 and West Germany Patent Publication (OLS) Nos. 2,219,917, 2,261,361, 2,329,587 and 2,433,812.

Magenta couplers which can be used in the present invention include 5-pyrazolone couplers, pyrazolo[5,1-c][1,2,4]triazoles described in U.S. Pat. No. 3,725,067 and pyrazolo[1,5-b][1,2,4]triazoles disclosed in European Pat. No. 119,860. Magenta couplers which are made two-equivalent by a releasable group bonded to the coupling active position via a nitrogen atom or an oxygen atom are also preferred.

As cyan couplers to be used in the present invention, couplers fact to high humidity and high temperature are used to advantage. Typical examples of such cyan couplers include phenol couplers as described in U.S. Pat. No. 3,772,002; 2,5-diacylaminophenol couplers described in Japanese Patent Application (OPI) Nos. 31953/84, 166956/84 and 24547/84; phenol couplers having a phenylureido group at the 2-position and an acylamino group at the 5-position disclosed in U.S. Pat. No. 4,333,999; and naphthol couplers described in Japanese Patent Application No. 93605/84.

In order to correct unnecessary side absorption present in a shorter wavelength side of main absorption of developed color image, a yellow- or magenta-colored coupler may be used in combination. These couplers are usually dissolved in a high-boiling organic solvent, such as phthalic or phosphoric esters having from 16 to 32 carbon atoms, or, if necessary, a mixture of the high-boiling organic solvent and a low boiling organic solvent, e.g., ethyl acetate, and then dispersed in an aqueous medium.

The yellow, magenta and cyan color couplers are generally used in amounts of from 0.01 to 0.5 mol, from 0.003 to 0.3 mol, and from 0.002 to 0.3 mol, respectively, each per mol of light-sensitive silver halide.

The photographic emulsions to be used in the present invention may be spectrally sensitized with known sensitizing dyes. Examples of dyes useful in the light-sensitive layer forming a positive cyan image have been described hereinbefore.

For the purpose of preventing fog during the preparation, preservation or photographic processing or stabilizing performance properties, known anti-foggants or stabilizers may be used. Specific examples of these additives and usages thereof are described, e.g., in U.S. Pat. Nos. 3,954,474 and 3,982,947, Japanese Patent Publication No. 28660/77, *Research Disclosure,* 17643, VIA to VIM (December, 1978), E. J. Birr, *Stabilization of Photographic Silver Halide Emulsions,* Focal Press (1974), etc.

The light-sensitive materials prepared by the present invention can contain hydroquinones, aminophenols, sulfonamidophenols, etc. as a color fog inhibitor or color mixing inhibitor. They can further contain various discoloration inhibitors, such as organic inhibitors, e.g., 5-hydroxycoumarans, spirocoumarans, etc.; and metal complex type inhibitors exemplified by bis-(N,N-dialkyldithiocarbamato)nickel complexes.

The light-sensitive materials according to the present invention can contain ultraviolet absorbents, such a benzotriazoles, with typical examples thereof being described, e.g., in *Research Disclosure,* 24239 (June, 1984). In addition, they can further contain in hydrophilic colloidal layers thereof water-soluble dyes as filter dyes or for various purposes including prevention of irradiation or halation.

Binders which can be used in the photographic light-sensitive layers or a backing layer of the light-sensitive materials according to the present invention include gelatins, modified gelatins, synthetic hydrophilic polymers, and the like. A hardener, such as vinylsulfonic acid derivatives, may be added to any of the hydrophilic colloidal layers, and a vinyl polymer having a sulfinic acid salt in its side chain may be used as a hardening accelerator.

The light-sensitive materials of the present invention can contain one or more surface active agents for broad purposes, for example, aid in coating, prevention of static charge, improvement of slipperiness, aid in emulsifying dispersion, prevention of adhesion, improvement of photographic characteristics, e.g., development acceleration and increase in contrast or sensitivity, and the like.

In addition to the above-enumerated additives, the light-sensitive materials of the present invention may contain a wide variety of photographic additives, such as stabilizers, stain inhibitors, developing agents or precursors thereof, development accelerators or precursors thereof, lubricants, mordants, matting agents, antistatics, plasticizers, and so on. Typical examples of these additives are recited in *Research Disclosure* 17643 (December, 1978) and ib. 18716 (November, 1979).

The present invention can suitably be applied to high-sensitive color films comprising a support having provided thereon at least two emulsion layers being sensitive to the same color and different in sensitivity. A typical order of these plural layers is red-sensitive layer—green-sensitive layer—blue-sensitive layer, but a layer structure wherein a high-sensitive layer is interposed between layers being different in color sensitivity may also be employed.

The light-sensitive materials of the present invention is developed with a developer composed mainly of an aromatic primary amine developing agent and then subjected to bleach followed by fixing, bleach-fix or a combination thereof. On this occasion, a bleach accelerator, e.g., iodine ion, thioureas, thiol compounds, etc., may be used in combination, if desired. After bleach-fix or fixing, the material is usually washed with water. Washing is conveniently carried out countercurrently by the use of two or more tanks to save water as stated in Japanese Patent Application (OPI) No. 8543/1982. The material may finally be subjected to multi-stage countercurrent stabilization process. In this process, a pH buffer or formalin may be added to a stabilizing bath. An ammonium salt is a preferred additive for the stabilizing bath.

The present invention will now be illustrated in greater detail with reference to the following examples, but it should be understood that the present invention is not limited thereto.

EXAMPLE 1

Sample 101 (Comparative Sample)

A multi-layer color photographic light-sensitive material was prepared by coating the following layers on a transparent triacetyl cellulose film support in the order listed. The resulting sample was designated as Sample 101.

1st Layer: Antihalation Layer

| A gelatin layer containing: | |
|---|---|
| Black colloidal silver | 0.15 g/m$^2$ |
| Ultraviolet Absorbent U-1 | 0.08 g/m$^2$ |
| Ultraviolet Absorbent U-2 | 0.12 g/m$^2$ |

2nd Layer: Intermediate Layer

| A gelatin layer containing: | |
|---|---|
| Fine grain silver halide emulsion (AgBr; mean grain size: 0.07 μm) | 0.2 g-Ag/m$^2$ |
| 2,5-Di-t-pentadecylhydroquinone | 0.18 g/m$^2$ |

3rd Layer: First Red-Sensitive Emulsion Layer

| A gelatin layer containing: | |
|---|---|
| Silver iodobromide emulsion (silver iodide: 4 mol %; mean grain size: 0.4 μm) | 1.2 g-Ag/m$^2$ |
| Sensitizing Dye I | $1.4 \times 10^{-4}$ mol per mol of Ag |
| Sensitizing Dye II | $0.4 \times 10^{-4}$ mol per mol of Ag |
| Sensitizing Dye III | $5.6 \times 10^{-4}$ mol per mol of Ag |
| Sensitizing Dye IV | $4.0 \times 10^{-4}$ mol per mol of Ag |
| Coupler C-1 | 0.45 g/m$^2$ |
| Coupler C-2 | 0.045 g/m$^2$ |
| Coupler C-3 | 0.025 g/m$^2$ |

4th Layer: Second Red-Sensitive Emulsion Layer

| A gelatin layer containing: | |
|---|---|
| Silver iodobromide emulsion (silver iodide: 8 mol %; mean grain size: 0.8 μm) | 1.0 g-Ag/m$^2$ |
| Sensitizing Dye I | $5.2 \times 10^{-5}$ mol per mol of Ag |
| Sensitizing Dye II | $1.5 \times 10^{-5}$ mol |

-continued

| A gelatin layer containing: | |
|---|---|
| | per mol of Ag |
| Sensitizing Dye III | $2.1 \times 10^{-4}$ mol per mol of Ag |
| Sensitizing Dye IV | $1.5 \times 10^{-5}$ mol per mol of Ag |
| Coupler C-1 | 0.050 g/m$^2$ |
| Coupler C-4 | 0.070 g/m$^2$ |
| Coupler C-2 | 0.035 g/m$^2$ |

5th Layer: Intermediate Layer

| A gelatin layer containing: | |
|---|---|
| 2,5-Di-t-pentadecylhydroquinone | 0.08 g/m$^2$ |

6th Layer: First Green-Sensitive Emulsion Layer

| A gelatin layer containing: | |
|---|---|
| Silver iodobromide emulsion (silver iodide: 4 mol %; mean grain size: 0.4 μm) | 0.80 g-Ag/m$^2$ |
| Sensitizing Dye V | $4.0 \times 10^{-4}$ mol per mol of Ag |
| Sensitizing Dye VI | $3.0 \times 10^{-5}$ mol per mol of Ag |
| Sensitizing Dye VII | $1.0 \times 10^{-4}$ mol per mol of Ag |
| Coupler C-5 | 0.45 g/m$^2$ |
| Coupler C-6 | 0.13 g/m$^2$ |
| Coupler C-7 | 0.02 g/m$^2$ |
| Coupler C-3 | 0.04 g/m$^2$ |

7th Layer: Second Green-Sensitive Emulsion Layer

| A gelatin layer containing: | |
|---|---|
| Silver iodobromide emulsion (silver iodide: 8 mol %; mean grain size: 0.8 μm) | 0.85 g-Ag/m$^2$ |
| Sensitizing Dye V | $2.7 \times 10^{-4}$ mol per mol of Ag |
| Sensitizing Dye VI per mol of Ag | $1.8 \times 10^{-5}$ mol |
| Sensitizing Dye VII | $7.5 \times 10^{-5}$ mol per mol of Ag |
| Coupler C-5 | 0.095 g/m$^2$ |
| Coupler C-6 | 0.015 g/m$^2$ |

8th Layer: Yellow Filter Layer

| | |
|---|---|
| Yellow colloidal Silver | 0.08 g-Ag/m$^2$ |
| 2,5-Di-t-pentadecylhydroquinone | 0.090 g/m$^2$ |

9th Layer: First Blue-Sensitive Emulsion Layer

| A gelatin layer containing: | |
|---|---|
| Silver iodobromide emulsion (silver iodide: 5 mol %; mean grain size: 0.3 μm) | 0.37 g-Ag/m$^2$ |
| Sensitizing Dye VIII | $4.4 \times 10^{-4}$ mol |

-continued

| A gelatin layer containing: | |
|---|---|
| | per mol of Ag |
| Coupler C-8 | 0.71 g/m$^2$ |
| Coupler C-3 | 0.07 g/m$^2$ |

10th Layer: Second Blue-Sensitive Emulsion Layer

| A gelatin layer containing: | |
|---|---|
| Silver iodobromide emulsion (silver iodide: 7 mol %; mean grain size: 0.9 μm) | 0.55 g-Ag/m$^2$ |
| Sensitizing Dye VIII | $3.0 \times 10^{-4}$ mol per mol of Ag |
| Coupler C-8 | 0.23 g/m$^2$ |

11th Layer: First Protective Layer

| A gelatin layer containing: | |
|---|---|
| Ultraviolet Absorbent U-1 | 0.14 g/m$^2$ |
| Ultraviolet Absorbent U-2 | 0.22 g/m$^2$ |

12th Layer: Second Protective Layer

| A gelatin layer containing: | |
|---|---|
| Silver iodobromide emulsion (silver iodide: 2 mol %; mean grain size: 0.07 μm) | 0.25 g-Ag/m$^2$ |
| Polymethacrylate particles (diameter: 1.5 μm) | 0.10 g/m$^2$ |

Each of the above layers further contained Gelatin Hardener H-1 and a surface active agent in addition to the above-described components.

Sample 102 (Invention)

Sample 102 was prepared in the same manner as described for Sample 101 with the following exception:

(1) A fogged emulsion layer and a DIR compound-containing layer having the following respective composition were provided between the 1st and 2nd layers.

Fogged Emulsion Layer

| A gelatin layer containing: | |
|---|---|
| Fogged emulsion* (silver iodide: 4 mol %; mean grain size: 0.4 μm) | 0.4 g-Ag/m$^2$ |
| Coupler C-1 | 0.15 g/m$^2$ |
| Coupler C-2 | 0.01 g/m$^2$ |

*The fogged emulsion was prepared by stirring the emulsion at 40° C. under white light before coating.

(2) The silver coverage of the 3rd layer was decreased to 0.85 g-Ag/m$^2$.

(3) The coverage of Coupler C-3 in the 6th layer was decreased to 0.02 g/m$^2$.

(4) The coverage of the 6th layer was decreased 0.9 times.

The compounds used in the preparation of Samples 101 and 102 are as follows:

U-1
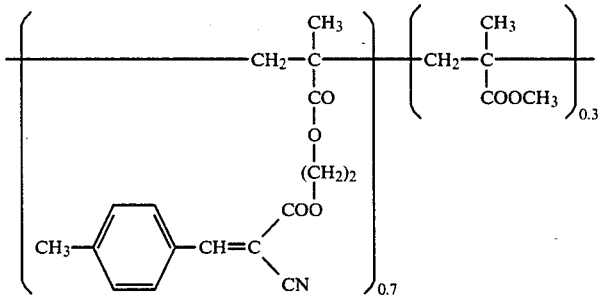
C-1
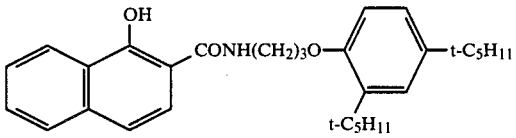
C-2
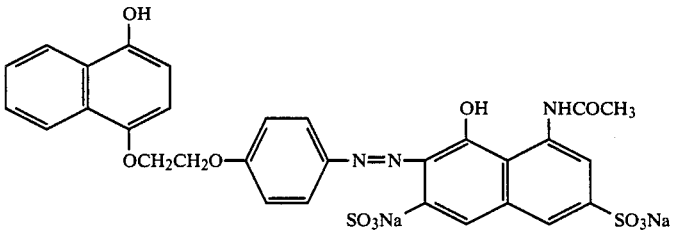
U-2
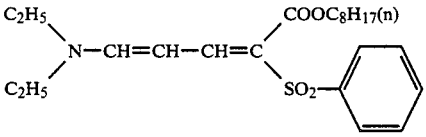
C-3
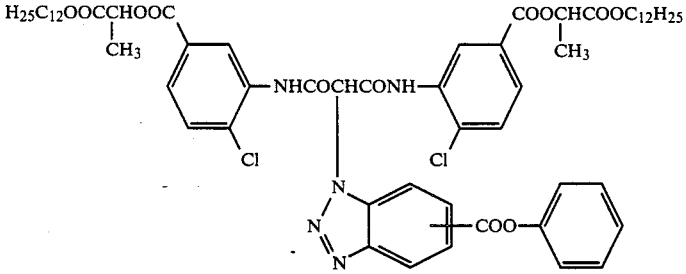
C-4
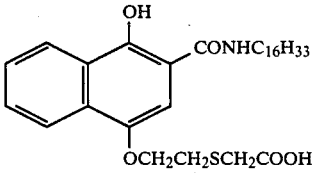
C-5
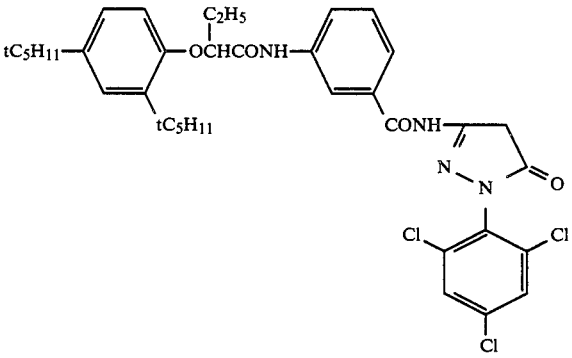

-continued
C-6
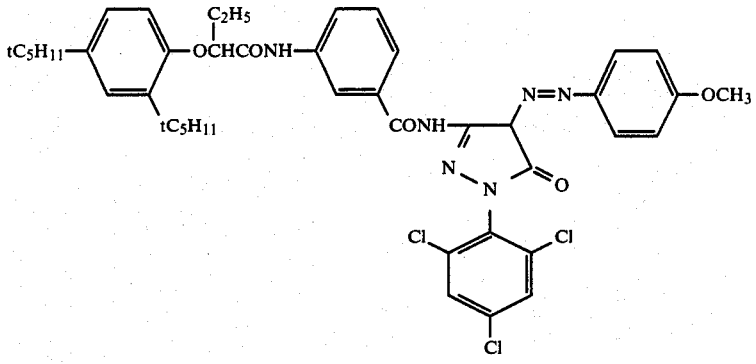
C-7
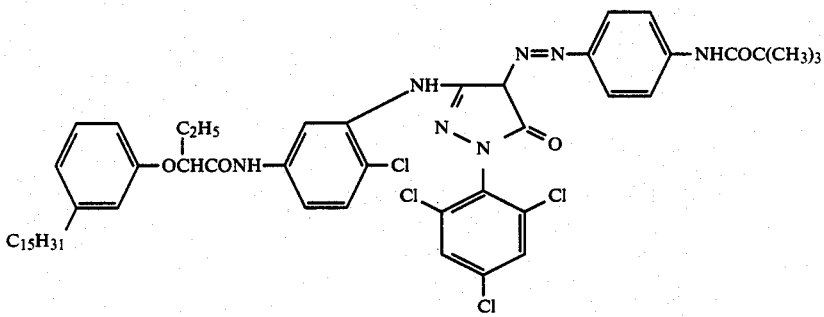
C-8
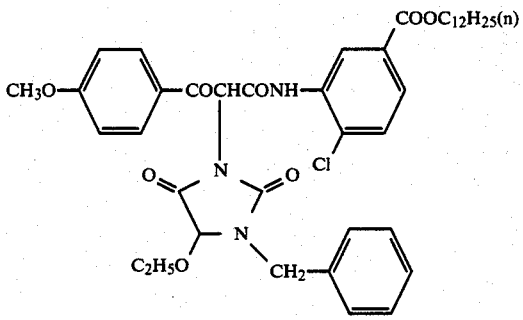
H-1
$CH_2{=}CH{-}SO_2{-}CH_2{-}CONH(CH_2)_2NHCO{-}CH_2{-}SO_2{-}CH{=}CH_2$
Sensitizing Dye:
I
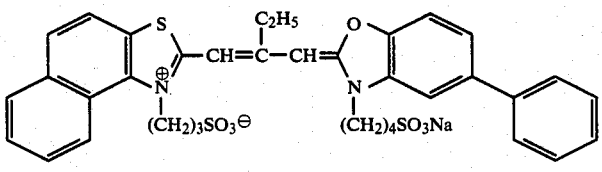
II
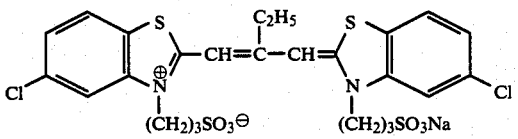
III
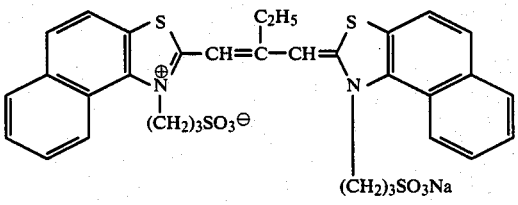

-continued

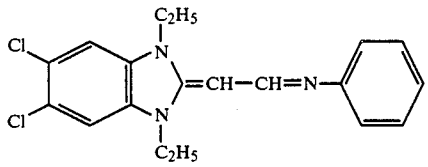

IV

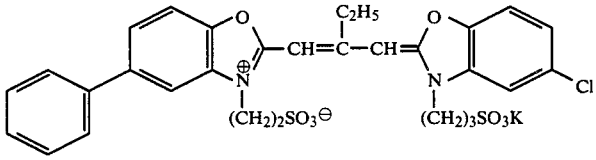

V

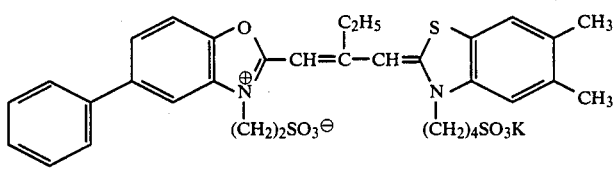

VI

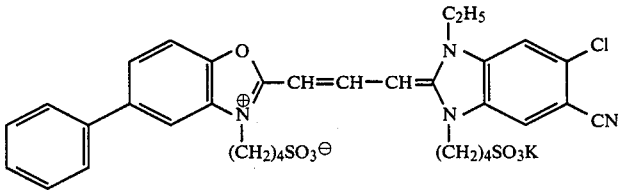

VII

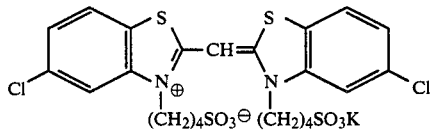

VIII

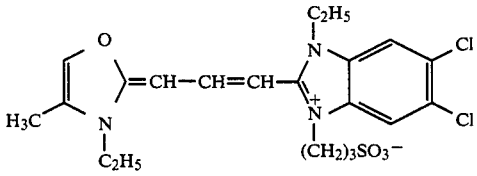

IX

Each of Samples 101 and 102 was sensitometrically exposed to white light and subjected to the following development processing for sensitometry. The development processing was conducted at 38° C.

| | |
|---|---|
| 1. Color Development | 3'15" |
| 2. Bleaching | 6'30" |
| 3. Washing | 3'15" |
| 4. Fixing | 6'30" |
| 5. Washing | 3'15" |
| 6. Stabilization | 3'15" |

The processing solution used in each step had the following composition:

| | |
|---|---|
| Color Developing Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 liter |

-continued

| | |
|---|---|
| Bleaching Solution: | |
| Ammonium bromide | 160.0 g |
| Aqueous ammonia (28%) | 25.0 ml |
| Sodium (ethylenediaminetetra-acetato)iron | 130.0 g |
| Glacial acetic acid | 14.0 ml |
| Water to make | 1 liter |
| Fixing Solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |
| Stabilizing Solution: | |
| Formalin | 8.0 ml |
| Water to make | 1 liter |

Results of sensitometry revealed substantial equality between Sample 101 and Sample 102 in terms of sensitivity and gradation.

Figure 3:
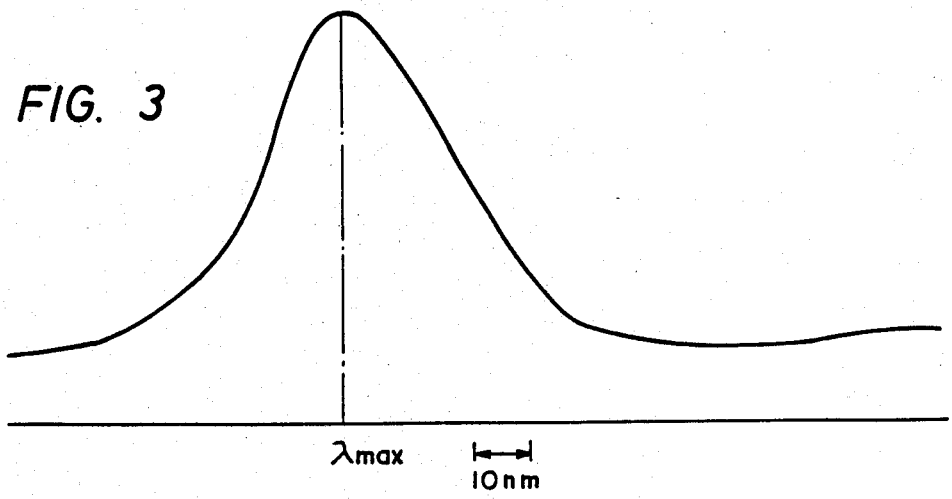
FIG. 3 illustrates a reflectance distribution possessed by a color chart of various green colors, in which the abscissa represents a wavelength and the ordinate represents a reflectance (%).

With respect to Sample 102, $\overline{\lambda}_G$ and $\overline{\lambda}_{-R}$ calculated according to the aforementioned formulae were as follows:

$\overline{\lambda}_G = 549$ nm $\overline{\lambda}_{-R} = 523$ nm $\overline{\lambda}_G - \overline{\lambda}_{-R} = 26$ nm Then, each of Samples 101 and 102 was cut in a 35 mm size and was used for photographing a color chart containing various green colors having spectral reflectances as shown in FIG. 3 and peak wavelengths ($\lambda_{max}$) of from 470 to 580 nm with a single-lens reflex camera. The sensitivity was set at ISO 100. After photographing, the material was subjected to the same processing as described above and printed on Fuji Color Paper manufactured by Fuji Photo Film Co., Ltd., in such a manner that a simultaneously photographed gray color might be reproduced, and the cyan density on the resulting print corresponding to the respective green color of the color chart was determined by means of Status A Filter manufactured by Macbeth Corp. The data obtaned are plotted in FIG. 4.

Figure 4:
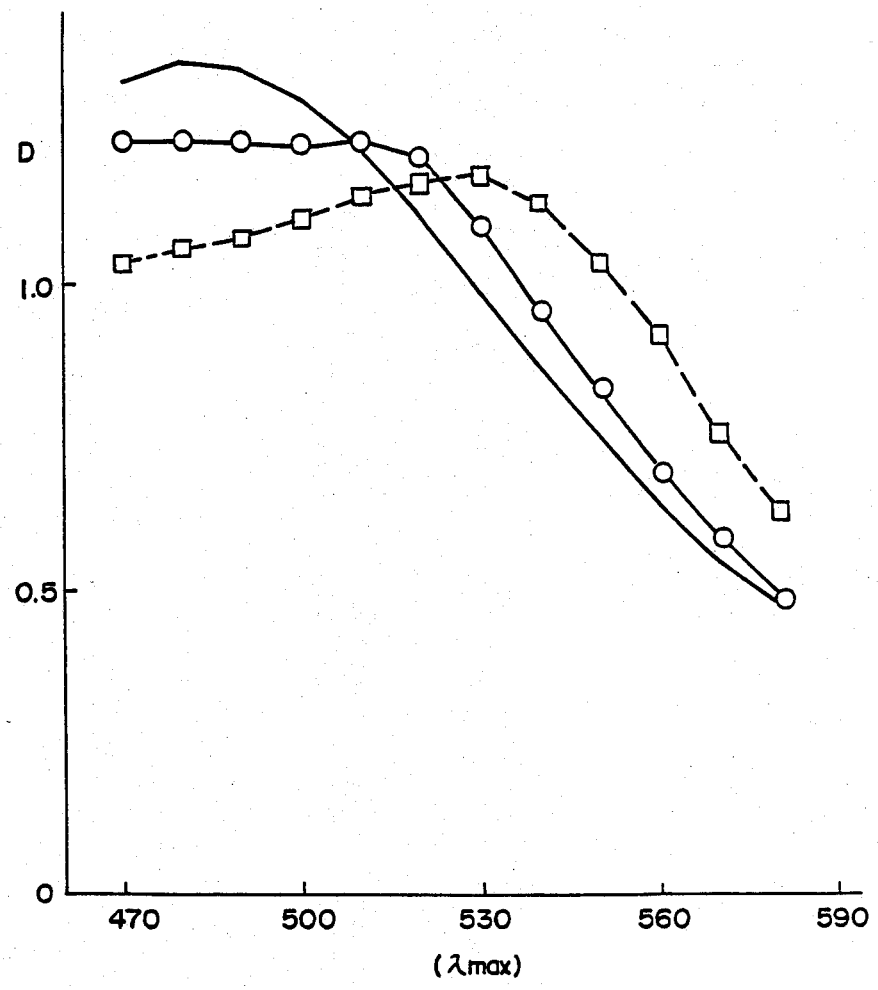
FIG. 4 illustrates curves of green color reproduction, in which a cyan density reproduced on a color print is plotted against the maximum absorption wavelength ($\lambda_{max}$) of the green color object to be reproduced. The solid line indicates a cyan density necessary for perfect color reproduction; the dotted line with squares indicates a cyan density reproduced by a comparative sample; and the solid line with circles indicates a cyan density reproduced by a sample according to the present invention.

Separately, cyan density on the same color paper necessary for reproducing each of the green colors completely equal to the corresponding green colors of the color chart was determined and also plotted in FIG. 4 in a solid line, which means an aimed color reproduction curve.

The results shown in FIG. 4 demonstrate the following considerations.

(1) Sample 101 shows color reproducibility of cyan shortage for cyan green objects having $\lambda_{max}$ less than 520 nm and, to the contrary, color reproducibility of cyan excess for green to brown objects having $\lambda_{max}$ more than 520 nm. Therefore, Sample 101 is not faithful in color reproduction.

(2) In Sample 102 according to the present invention, the colors reproduced from objects having $\lambda_{max}$ less than 500 have cyan densities nearly approaching to the aimed color reproduction curve, and the colors reproduced from objects having $\lambda_{max}$ more than 530 nm show cyan densities falling near to the aimed curve, as compared with Sample 102. It can be seen from these results that an excellent color negative film exhibiting color reproducibility near to an aim over the whole wavelength region can be obtained by the present invention.

While the invention has been described in detail and with reference to the specific embodiments thereof, it will be apparent to one skilled in the art that various changes and modifications can be made therein without departing from the spirit and scope thereof.

What is claimed is:

1. A color photographic light-sensitive material comprising a support having provided thereon at least one red-sensitive silver halide emulsion layer, at least one green-sensitive silver halide emulsion layer and at least one blue-sensitive silver halide emulsion layer, wherein the green-sensitive silver halide emulsion layer has a spectral sensitivity distribution whose weight-averaged wavelength of sensitivity ($\overline{\lambda}_G$) ranges from 520 nm to 580 nm both inclusive and the material further contains at least one silver halide emulsion layer which is light-responsive opposite to the above-described silver halide emulsion layers and froms an image having substantially the same hue as that of an image formed by said red-sensitive silver halide emulsion layer and whose spectral sensitivity distribution has a weight-averaged wavelength of sensitivity ($\overline{\lambda}_{-R}$) ranging from 500 nm to 560 nm both inclusive.

2. A color photographic light-sensitive material as in claim 1, wherein $\overline{\lambda}_{-R}$ is less than $\overline{\lambda}_G$.

3. A color photographic light-sensitive material as in claim 1, wherein $\overline{\lambda}_{-R}$ is less than $\overline{\lambda}_G$ by at least 5 nm.

4. A color photographic light-sensitive material as in claim 1, wherein $\overline{\lambda}_{-R}$ is less than $\overline{\lambda}_G$ by at least 10 nm.

5. A color photographic light-sensitive material as in claim 1, wherein said silver halide emulsion layer which is light-responsive opposite to other layers comprises a combination of a positive emulsion and a cyan color-forming coupler.

6. A color photographic light-sensitive material as in claim 1, wherein said silver halide emulsion layer which is light-responsive opposite to other layers comprises a combination of a negative emulsion and a cyan-colored coupler.

7. A color photographic light-sensitive material as in claim 1, wherein said silver halide emulsion layer which is light-responsive opposite to other layers comprises a combination of a negative emulsion, a DIR coupler or DIR compound capable of releasing a developing inhibitor upon coupling with an oxidized product of a developing agent and a previously fogged emulsion.

8. A color photographic light-sensitive material as in claim 1, wherein said silver halide emulsion layer which is light-responsive opposite to other layers comprises a combination of a negative emulsion and a dye releasing redox compound or diffusible dye releasing coupler capable of releasing a complete cyan dye upon coupling with an oxidized product of an developing agent.

9. A color photographic light-sensitive material as in claim 7, wherein said silver halide emulsion layer which is light-responsive opposite to other layers and has been spectrally sensitized so as to have $\overline{\lambda}_{-R}$ of from 500 nm to 560 nm both inclusive contains a DIR compound capable of releasing a development inhibitor or a precursor thereof upon coupling with an oxidized product of a developing agent, and said emulsion layer or an adjacent layer contains a previously fogged silver halide emulsion and a coupler capable of forming an image having substantially the same hue as that of an image of the red-sensitive silver halide emulsion layer.

* * * * *